US007354317B2

(12) United States Patent
Witham et al.

(10) Patent No.: US 7,354,317 B2
(45) Date of Patent: Apr. 8, 2008

(54) LAMP KEYING SYSTEM AND METHOD

(75) Inventors: David L. Witham, Ventura, CA (US); Roberto E. Arance, Castaic, CA (US); Keith M. Crawford, Canyon Country, CA (US); Michael A. Pedersen, Van Nuys, CA (US); Michael A. Jacques, Sylmar, CA (US)

(73) Assignee: Ultraviolet Devices, Inc., Valencia, CA (US)

( * ) Notice: Subject to any disclaimer, the term of this patent is extended or adjusted under 35 U.S.C. 154(b) by 0 days.

(21) Appl. No.: 11/600,397

(22) Filed: Nov. 16, 2006

(65) Prior Publication Data

US 2007/0058367 A1 Mar. 15, 2007

Related U.S. Application Data

(63) Continuation-in-part of application No. 10/754,851, filed on Jan. 9, 2004, now Pat. No. 7,137,728.

(60) Provisional application No. 60/440,908, filed on Jan. 15, 2003.

(51) Int. Cl.
*H01R 13/64* (2006.01)

(52) U.S. Cl. ..... 439/680; 362/652; 362/548; 439/226; 439/242

(58) Field of Classification Search ..... 439/242, 439/680, 677; 362/652, 548
See application file for complete search history.

(56) References Cited

U.S. PATENT DOCUMENTS

| | | | | |
|---|---|---|---|---|
| 5,381,070 | A | 1/1995 | Tuttle et al. | |
| 5,471,375 | A * | 11/1995 | Lau | 362/260 |
| 5,521,460 | A | 5/1996 | Zhu | |
| 6,083,021 | A | 7/2000 | Lau | |
| 6,323,588 | B1 | 11/2001 | Lilljedahl et al. | |
| 6,346,767 | B1 | 2/2002 | Swadel et al. | |
| 7,137,728 | B2 * | 11/2006 | Witham et al. | 362/652 |

* cited by examiner

*Primary Examiner*—Tho D. Ta
(74) *Attorney, Agent, or Firm*—Cislo & Thomas, LLP

(57) ABSTRACT

A system and a method for keying lamps which involve a lamp keying device such as a keying device with at least one base protruding key being formed on the base and at least one support slot being formed in the lamp support receptacle, the at least one base protruding key detachably coupling with the at least one support slot; a keying device with at least one support protruding key being formed on the lamp support receptacle and at least one base slot being formed in the base, the at least one base slot detachably coupling with the at least one protruding support key; and a keying device with at least one base protruding key being formed on the base and at least one base slot being formed in the base, the keying device further having at least one complementary support protruding key being formed on the lamp support receptacle and at least one complementary support slot being formed in the lamp support receptacle, the at least one base protruding key detachably coupling with the at least one complementary support slot, and the at least one base slot detachably coupling with the at least one complementary protruding support key.

23 Claims, 5 Drawing Sheets

LAMP KEYING SYSTEM AND METHOD

CROSS-REFERENCE TO RELATED APPLICATION(S)

This document is a continuation-in-part application and claims priority to, U.S. patent application Ser. No. 10/754,851, entitled "Lamp Keying System," filed on Jan. 9, 2004, U.S. Pat. No. 7,137,728, which is herein incorporated by this reference thereto for all purposes, in turn, claiming priority from U.S. Provisional Application Ser. No. 60/440,908, entitled "Apparatus and Method for Keying Lamp and Lamp Fixture," filed on Jan. 15, 2003, which is herein incorporated by this reference thereto for all purposes.

TECHNICAL FIELD

The present invention technically relates to lamp systems. More specifically, the present invention technically relates to ultraviolet lamp systems. Even more specifically, the present invention technically relates to ultraviolet lamp systems having a keying device.

BACKGROUND ART

Manufacturers and agencies associated with the lighting industry have developed standard lamp bases (incorporated into the lamp assembly itself) and corresponding lamp holders. The basis for these related art bases and holders is to provide the market with standardized products for facilitating a competitive environment where multiple lamp manufacturers and lamp fixture manufacturers could develop and sell interchangeable components that met the basic needs of the lighting market. Standard lamp base standards, including, but not limited to, T5, T8, Tb, T12, 2G7, 2G11, G23 and GX23, as designated for lamps manufactured by Philips Lighting™ and others, may have been developed as common standards to facilitate the implementation of lamps into various applications. Manufacturers have developed many different lamp models based on these standard lamp bases.

In many applications, the lamp base standards serve the industry well. However, in certain applications, utilization of the standard lamp base configurations can be detrimental. Typically, different model lamps manufactured on one particular lamp base standard vary greatly in terms of lamp voltage, current, illumination and power rating. This condition may present problems with respect to proper and safe usage of lamps with certain lamp fixtures. "Blind" utilization of the standard lamp bases by manufacturers within lamp fixtures creates a situation where the lay person consumer or user may easily, potentially, and unknowingly, implement the wrong lamp type for the device employed. Sometimes lamp models with different power and current ratings utilize the same apparent configuration, e.g. Philips Lighting™ Model Nos. TUV36WPLL and TUV60WPLL, which only serves to increase the probability of an incorrect lamp implementation by the user.

Another problem in the related art lamp devices may be in their performance. Lamp power is often critical to the performance of the system employing the lamp. For instance, where lamps are used for non-illumination purposes, including germicidal applications, the effective dosage of the system may be predominately affected by the power of the lamp being utilized. Utilization of the incorrect lamp in such systems results in failure of the system to achieve critical dosing, which may be required and/or specified. This may result in the device failing to meet the specified performance.

Yet other problems in the related art are unreliability and liability. The reliability of the device employed can be adversely affected by the implementation of the incorrect lamp. Impedance differences associated with different lamp models can induce problems with an employed system. Reliability and liability issues surrounding misapplication of lamps may include implementation of an incorrect lamp which causes premature lamp failure, thereby resulting in loss of performance and breach of warranty. Furthermore, implementation of an incorrect lamp may cause premature ballast (power supply) and controller failure, thereby also resulting in loss of performance and breach of warranty. Implementation of an incorrect lamp can cause operation of a device to go outside of acceptable thermal and electrical limits. This condition can result in loss of performance, breach of warranty, and personal injury liability. Also, as discussed in the preceding sections, the implementation of an incorrect lamp resulting in diminished dosage performance may result in injury, especially in germicidal applications, and personal injury liability claims by the consumer.

Yet another problem in the current art is related to marketing. In many cases, an advantage to the manufacturer and provider of equipment exists in requiring replacement parts to be distributed through their own channels of distribution. With a standard lamp base and fixture, replacement lamps may come from any source; and the channels of distribution and sales cannot be assured.

Some manufacturers may have made, or deferred to, the decision to offer products that rely primarily on the knowledge of the user and the utilization of the standard lamp bases to ensure the proper continued operation of their systems in application. This strategy may result in a potential misapplication of their systems, although it may provide a lowest cost approach for the initial device sale and also in lamp replacement sales.

Yet another problem can occur which creates a safety issue. Fluorescent lamps for illumination are currently manufactured and sold with the same lamp configuration and base as germicidal lamps. Due to increased sales of UV germicidal fixtures for treating air in commercial and residential HVAC systems, UV germicidal lamps are sold through marketing channels available to consumers. An unknowing consumer could actually buy a germicidal lamp from a retail store and place it in the receptacle of a normal fluorescent illumination lamp fixture, thereby creating a dangerous situation. Fluorescent illumination fixtures do have the safeguards and carry the warnings associated with UV fixtures. Of utmost concern, UV lamps can be harmful to the skin and the eyes. What is needed is a system that may address these and other problems associated with lamp fixtures and assemblies.

DISCLOSURE OF THE INVENTION

Provided are exemplary embodiments of a system and method for allowing predetermined and/or preconfigured lamp assemblies to be utilized with lamp fixtures. The exemplary embodiments may include a fixture assembly, a key configured to couple to the lamp fixture, and a lamp assembly including a base with a receiving structure, wherein the receiving structure is configured to engage the key, such that only predetermined lamp assemblies may couple to the fixture assembly. In addition, a protruding key may be place on the lamp base. When the lamp is inserted into the receiving structure or receptacle, a slot in the structure engages the key of the base.

The present lamp keying system generally comprises: a lamp base including a recess at one end; a lamp support, having a lamp support receptacle, being detachably coupled to the lamp base, and including a first portion to receive the lamp base and a second portion being recessed away from the received lamp base; and a lamp keying device selected from a group consisting essentially of: a keying device comprising at least one base protruding key being formed on the base and at least one support slot being formed in the lamp support receptacle, the at least one base protruding key detachably coupling with the at least one support slot; a keying device comprising at least one support protruding key being formed on the lamp support receptacle and at least one base slot being formed in the base, the at least one base slot detachably coupling with the at least one protruding support key; and a keying device comprising at least one base protruding key being formed on the base and at least one base slot being formed in the base, the keying device further comprising at least one complementary support protruding key being formed on the lamp support receptacle and at least one complementary support slot being formed in the lamp support receptacle, the at least one base protruding key detachably coupling with the at least one complementary support slot, and the at least one base slot detachably coupling with the at least one complementary protruding support key.

The present method of fabricating a lamp keying system generally comprises the steps of: providing a lamp base including a recess at one end; providing a lamp support, having a lamp support receptacle, being detachably coupled to the lamp base, and including a first portion to receive the lamp base and a second portion being recessed away from the received lamp base; and providing a lamp keying device selected from a group consisting essentially of: a keying device comprising at least one base protruding key being formed on the base and at least one support slot being formed in the lamp support receptacle, the at least one base protruding key detachably coupling with the at least one support slot; a keying device comprising at least one support protruding key being formed on the lamp support receptacle and at least one base slot being formed in the base, the at least one base slot detachably coupling with the at least one protruding support key; and a keying device comprising at least one base protruding key being formed on the base and at least one base slot being formed in the base, the keying device further comprising at least one complementary support protruding key being formed on the lamp support receptacle and at least one complementary support slot being formed in the lamp support receptacle, the at least one base protruding key detachably coupling with the at least one complementary support slot, and the at least one base slot detachably coupling with the at least one complementary protruding support key.

Advantages of the present invention include preventing person injury and minimizing breach of warranty, increased performance, and increasing reliability. Other features of the present invention are disclosed, or are apparent, in the section entitled "Mode(s) for Carrying-Out the Invention," disclosed, infra.

BRIEF DESCRIPTION OF THE DRAWING

For better understanding of the present invention, reference is made to the below-referenced accompanying Drawing. Reference numbers refer to the same or equivalent parts of the present invention throughout the several figures of the Drawing.

MODE(S) FOR CARRYING-OUT THE INVENTION

Figure 1:
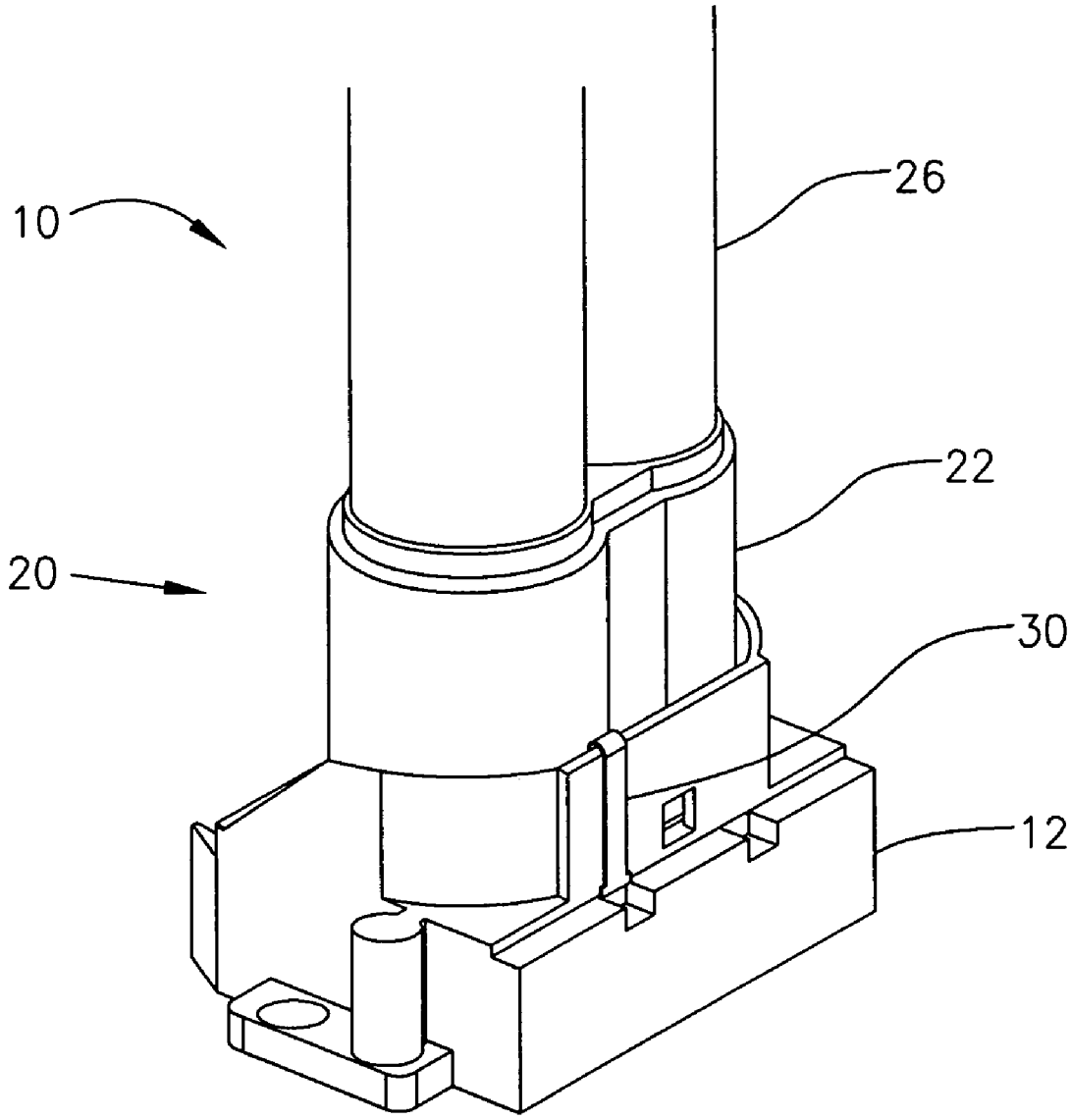
FIG. 1 is a perspective view of a system according to an exemplary embodiment of the present invention.

FIG. 1 generally shows a perspective view of a lamp system 10 according to an exemplary embodiment of the present invention. The lamp system 10 includes a lamp assembly 20, a lamp support in the form of a fixture or fixture assembly 12, and a key 30. The fixture assembly 12 is configured to receive the lamp assembly 20 for operatively receiving and coupling with the lamp assembly 20. The lamp assembly 20 includes a base 22 and an electromagnetic energy source 26. The base 22 is configured to couple with the fixture assembly 12, such that the electromagnetic energy source 26 will emit electromagnetic energy when power is applied, and when the lamp assembly 22 is operatively coupled to fixture assembly 12.

The key 30 may be configured such that only certain types of lamp assemblies are utilized with fixture assembly 12. In this manner, only certain predetermined and/or preconfigured lamp assemblies are utilized with particular fixture assemblies. This feature decreases the likelihood that improper lamp assemblies can be utilized with particular fixture assemblies, setups, and lamp systems. With this configuration only proper lamp assemblies are operatively coupled with the fixture assemblies. Thus, the use of incorrect lamp assemblies for the particular application, configuration, and/or fixture assembly is reduced or eliminated in the present invention.

The fixture assembly 12 comprises at least one material such as a polymer, a plastic, a metal, a ceramic, and a composite, or other materials, as desired, such as are used in to existing lamp fixture assemblies. The key 30 is made from plastic, metal, or other materials, as desired, as well as from metal, such that it may slightly flex and allow coupling of lamp assembly 20 to fixture assembly 12.

The base 22 comprises at least one material such as a polymer, a plastic, a metal, a ceramic, and a composite, or other materials, as desired, such as are currently utilized for lamp bases. Electromagnetic energy source 26 may be incandescent, ultraviolet, or any other type of electromagnetic energy source. Other electromagnetic energy sources may be utilized for other applications, as desired.

Still referring to the FIG. 1, a standard lamp fixture assembly 12 can be modified in order to achieve the desiratum of the present invention. In this embodiment, the fixture assembly 12 is modified to receive a clip or a key 30 in stable fashion. The key 30 may couple with the fixture assembly 12 such that the key 30 particularly couples to a coupling structure of fixture assembly 12.

Figure 2:
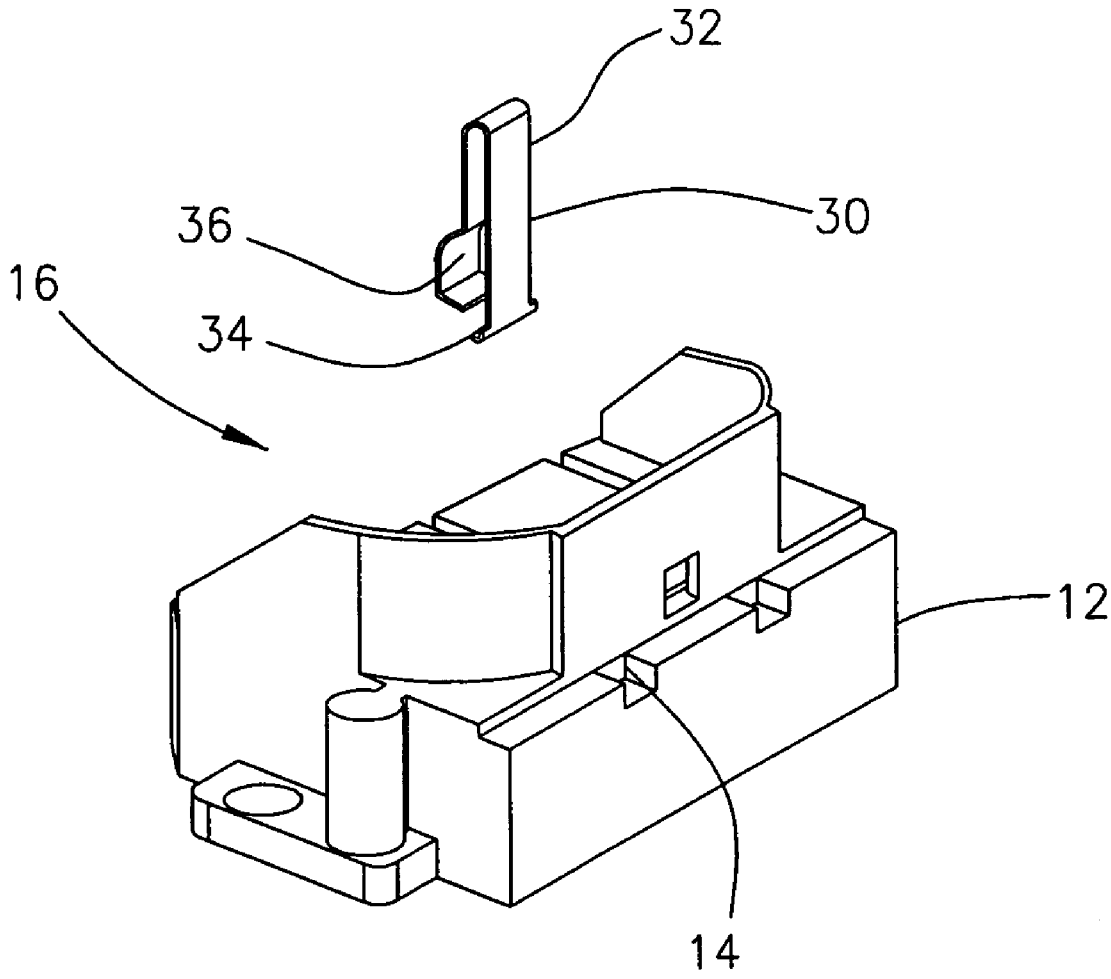
FIG. 2 is a detailed view of a fixture and a key according to an exemplary embodiment of the present invention.

The more detailed views of the fixture assembly 12 and the key 30 are shown in FIG. 2. As shown, the key 30 may include an extending portion 32 which curves around and forms a fixture coupling portion 34, and a base engaging portion 36. The fixture coupling portion 34 is configured to couple with a coupling structure 14 of the fixture assembly 12. With this configuration, the key 30 may be utilized with a fixture assembly 12 to allow only certain lamp assemblies to be utilized with the fixture assembly 12. Although fixture coupling portion 34 in this embodiment is shown as a lip-type configuration, other configurations may be utilized, as desired. Similarly, although the coupling structure 14 is shown as a recess or a slot, other configurations may be utilized, as desired, in the present invention.

The extending portion 32 is configured to extend over a portion of the fixture assembly 12 such that it will extend into a receptacle portion 16 of fixture assembly 12, which may be configured to receive a lamp assembly. Furthermore, the key 30 may include a base engaging portion 36, which may be configured to engage a portion of lamp assembly and/or allow lamp assembly to operatively couple to fixture assembly 12. Utilizing this key configuration, only predetermined or preconfigured lamp assemblies may be utilized with a fixture assembly. Receptacle portion 16 may be configured to couple to a base portion of a lamp assembly to allow the lamp assembly to operatively couple to the fixture assembly.

Figure 3:
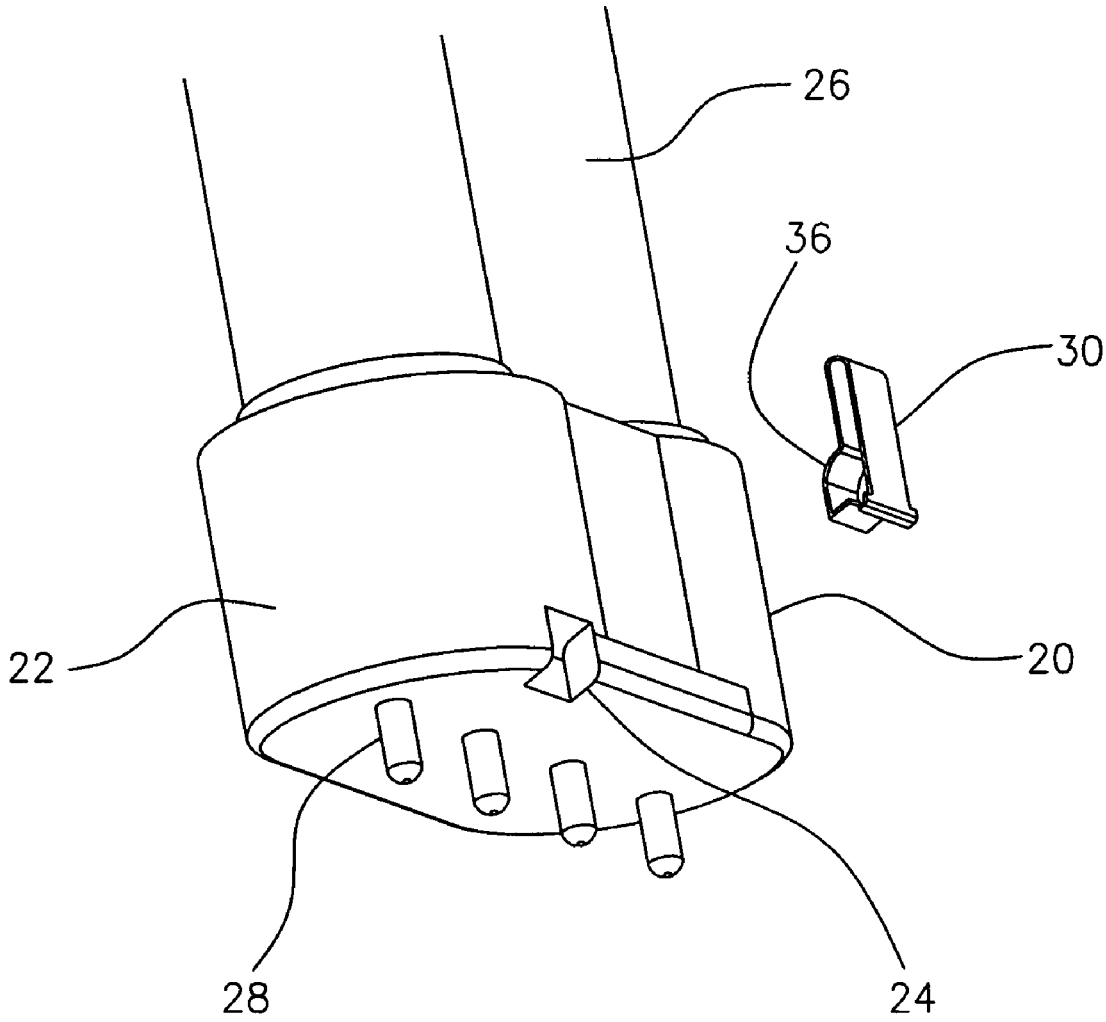
FIG. 3 is a detailed view of a lamp assembly and a key according to an exemplary embodiment of the present invention.

FIG. 3 shows a more detailed view of the lamp or the lamp assembly 20 and the key 30, in accordance with the present invention. In this exemplary embodiment, the lamp assembly 20 again includes the base 22 and the electromagnetic energy source 26. The lamp assembly 20 further includes a receiving structure 24. The receiving structure 24 is configured to couple with the base engaging portion 36 of the key 30. Although the receiving structure 24 is shown as a recess or slot, other configurations may be utilized, as desired in the present invention. Furthermore, different configurations for the key 30 may be utilized to engage with, or couple with, the lamp assembly 20, as desired.

The base engaging portion 36 of the key 30 may be configured to fit into the recess 24 and may be placed within the system at different positions to allow different types of lamp assemblies to be utilized with a single fixture assembly. Similarly, the receiving structure 24 may be positioned at different positions adjacent to the lamp assembly. Different positions for receiving structure 24 may be utilized with different types of lamp assemblies to reduce the likelihood that a user will install an improper lamp assembly into a fixture. With this configuration, and position of the key 30, the lamp assembly 20 may operatively coupled with a fixture assembly such that it will illuminate and operate properly.

With this configuration, the key 30 may be utilized with existing fixture assemblies, such that only certain lamp assemblies may be utilized within a lamp system and the fixture assemblies. Furthermore, current lamp assemblies may be modified to allow operative coupling to proper, predetermined fixture assemblies, such that a user may be less likely to install an improper lamp assembly in a particular lamp system and/or fixture.

Additionally, systems may be originally configured to include keys and/or the receiving structure 24, or other configuration to reduce or eliminate the use of improper replacement lamp assemblies with a particular fixture assembly. In this manner, lamp assemblies that do not produce a desired result may be reduced or eliminated from use when a user is replacing the lamp assembly within a lamp system. This may be particularly important when a certain type of ultraviolet lamp or other type of lamp must be utilized for a particular configuration and/or utilization, such as in a disinfection system, which may require certain wattages, etc. for proper operation.

The lamp assembly 20 may also include electrical contacts 28, which may be configured to electrically couple with corresponding electrical contacts (not shown) of the fixture assembly 12. The electrical contacts 28 provide a pathway for an applied current to flow to the electromagnetic radiation source 26, whereby the source 26 is powered, when the lamp assembly 20 is operatively coupled with the fixture 12.

Referring to the FIG. 3, the electromagnetic energy source 26, having a base 22 in this instance, is formed with a custom receiving structure 24 such that the base engaging portion 36 of the key 30 will prevent the lamp assembly 20, and more specifically the base 22, from becoming associated with the fixture 12. Thus a very simple straight-forward methodology and device may be employed to insure that a lamp assembly 20, for example, is not associated with an unintended fixture or a receptacle 12.

While the embodiment illustrated shows but a single protrusion or base engaging portion, to be associated with the receiving structure 24, more than one slot and/or key may be utilized for various applications, as desired. Additionally, while a specific configuration of a receiving structure 24 and a base engaging portion 36 has been illustrated and described, it the slots and accommodating protrusions may take various polygonal and geometric shapes and all such matters are within the contemplation of the present invention.

With respect to the lamp, the exemplary embodiments of the present method and system impart an inexpensive solution for customizing standard lamp bases and for minimizing the probability of lamp misapplication in systems. The resulting lamp configuration incorporates coupling configurations, including, but not limited to, a slot or recess in addition to the normal geometric aspects of standard lamp base, including, but not limited to, standard lamp bases designated as 2G11, 2G7, G23, GX23. This coupling configuration allows a corresponding and reciprocal key, rib, or post to operatively engage the corresponding lamp base, holder, or fixture. However, other configurations may be utilized as desired.

With respect to the lamp holder, the exemplary embodiments of the present method and system include an inexpensive configuration for customizing existing commercially available lamp holders, bases, and fixtures that may minimize lamp misapplication. The resulting lamp fixture configuration incorporates a receiving structure, including, but not limited to a rib, bracket or post, into the mating surface(s) in addition to the normal geometric aspects of a particular standard lamp base as between the lamp and lamp holder. This receiving structure may correspond to the additional and corresponding receiving structure adjacent to the lamp base as above noted.

The incorporation of the receiving structure, in addition to the normal geometric attributes of the standard lamp base type, may create a physical interference to prevent normal installation of an improper lamp into this fixture. The lamp may be effectively matched or "keyed" for fitting in the corresponding lamp fixture. However, this receiving structure may also allow the implementation of a lamp base that has the appropriate reciprocal interference relief features. With this configuration, the lamp device manufacturer may provide a cost effective system to end users that may minimize the opportunity for misapplication of lamps within the lamp device.

The present method M1 of fabricating a lamp keying system 10 generally comprises the steps of: providing a lamp base 22 including a recess at one end; providing a lamp support 45, having a lamp support receptacle 44, being detachably coupled to the lamp base 22, and including a first portion to receive the lamp base 22 and a second portion being recessed away from the received lamp base 22; and providing a lamp keying device having one of the following configurations: (a) a keying device comprising at least one base protruding key 41 being formed on the base 22 and at least one support slot 42 being formed in the lamp support receptacle 44, the at least one base protruding key 41 detachably coupling with the at least one support slot 42; (b) a keying device comprising at least one support protruding key 43 being formed on the lamp support receptacle 44 and at least one base slot 24 being formed in the base 22, the at least one base slot 24 detachably coupling with the at least one protruding support key 43; and (c) a keying device comprising at least one base protruding key 41 being formed on the base 22 and at least one base slot 24 being formed in the base 22, the keying device further comprising at least one complementary support protruding key 43 being formed on the lamp support receptacle 44 and at least one complementary support slot 42 being formed in the lamp support receptacle 44, the at least one base protruding key 41 detachably coupling with the at least one complementary support slot 42, and the at least one base slot 24 detachably coupling with the at least one complementary protruding support key 43.

This invention may establish a method M2 for "keying" a lamp and lamp holder to minimize the potential for misapplication of lamps within a lamp fixture, i.e., the method of using the lamp keying system. The method M2 provides for implementing unique mechanical features in standard lamp assemblies and lamp fixtures/holders/receptacles. The features provided may be a "male to female" coupling relationship between the two components, i.e., the lamp base and the lamp receptacle, and may be unique for minimizing the possibility for incorporation of an incorrect lamp into an existing fixture. However, other configurations may be utilized, as desired. This method may incorporate mechanical interference into the lamp fixture which prevents the insertion of a lamp that does not have the proper and corresponding interference relief feature.

With this configuration, existing lamp fixtures and lamps may be modified to prevent misapplication of a lamp to a fixture and to insure that lamps of the various types are associated only with fixtures for which the lamp is intended to be used. Furthermore, exemplary embodiments may provide a methodology and a system for insuring that correct lamps are used in specific applications and that misuse may be eliminated or reduced by the provision of a keying element or elements.

Figure 4:
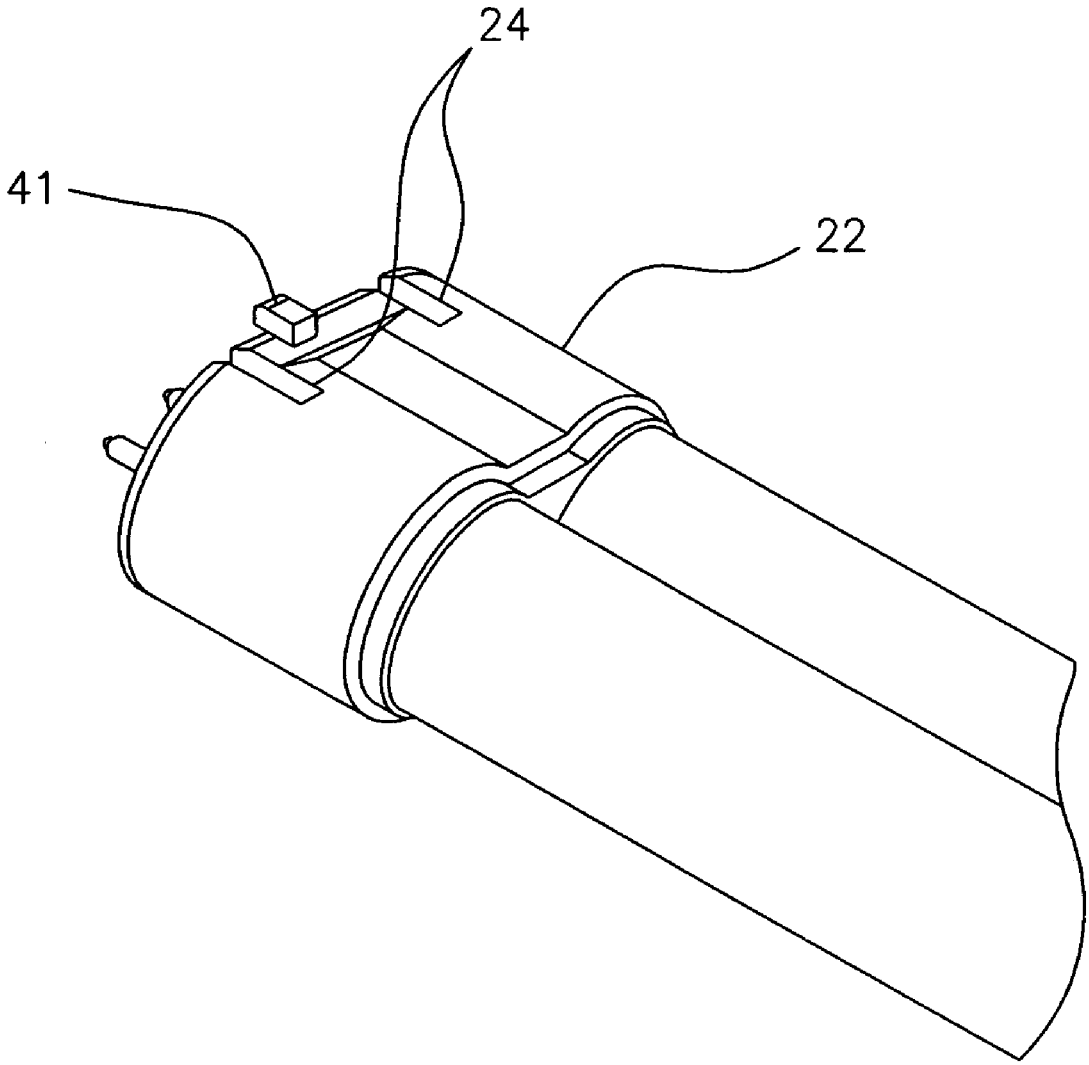
FIG. 4 is a perspective view of an alternative embodiment of the present invention, comprising a lamp keying device which includes a unique combination of protruding keys and slots which further limits use of some lamps.
Figure 5:
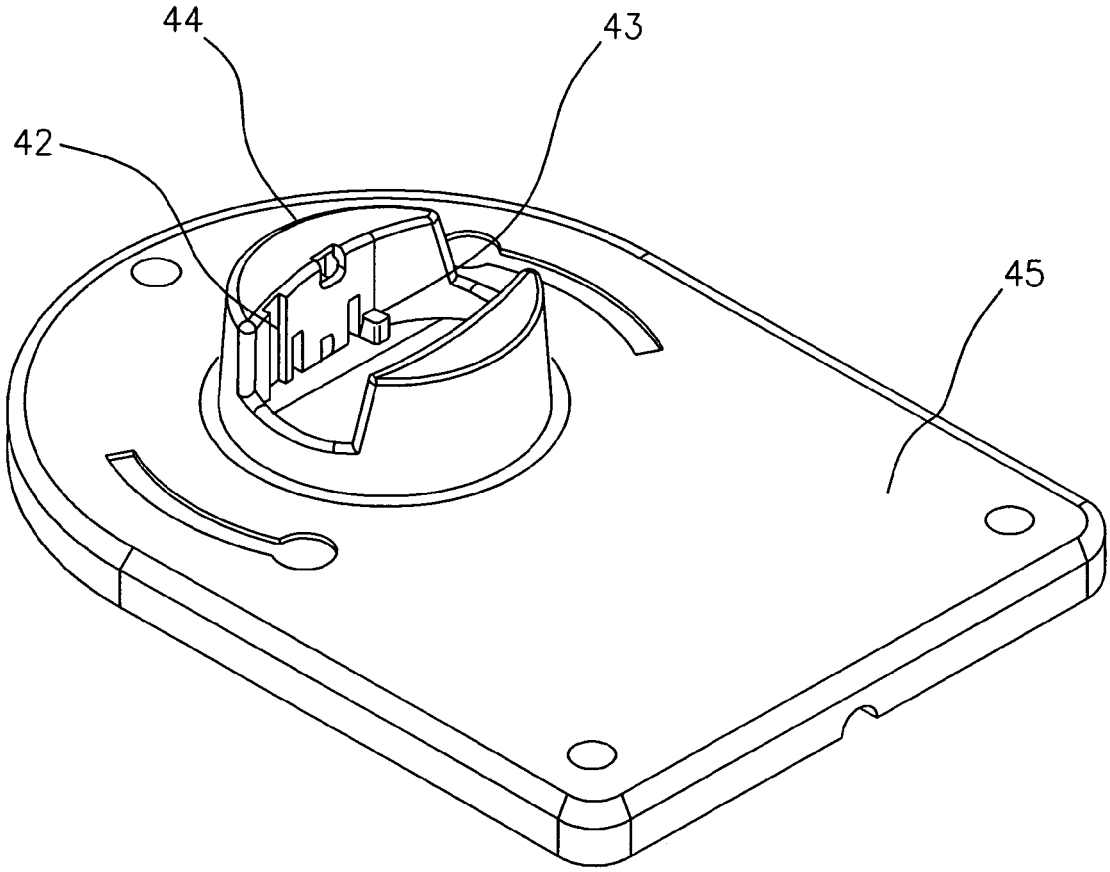
FIG. 5 is a perspective view of the receiving structure in a lamp support for the alternate embodiment of the present invention as shown in FIG. 4.

Referring to FIGS. 4 and 5 together, FIG. 4 shows the details of an alternate embodiment of the present invention, comprising an integrally-formed protruding keying device. The lamp keying device has one of the following configurations: (a) a keying device comprising at least one base protruding key 41 being formed on the base 22 and at least one support slot 42 being formed in the lamp support receptacle 44, the at least one base protruding key 41 detachably coupling with the at least one support slot 42; (b) a keying device comprising at least one support protruding key 43 being formed on the lamp support receptacle 44 and at least one base slot 24 being formed in the base 22, the at least one base slot 24 detachably coupling with the at least one protruding support key 43; and (c) a keying device comprising at least one base protruding key 41 being formed on the base 22 and at least one base slot 24 being formed in the base 22, the keying device further comprising at least one complementary support protruding key 43 being formed on the lamp support receptacle 44 and at least one complementary support slot 42 being formed in the lamp support receptacle 44, the at least one base protruding key 41 detachably coupling with the at least one complementary support slot 42, and the at least one base slot 24 detachably coupling with the at least one complementary protruding support key 43. FIG. 5 illustrates, in a perspective view, a lamp support 45, incorporating a lamp support receptacle 44, as shown in FIG. 4.

Exemplary embodiments may also provide a means of insuring that ultraviolet light lamp assemblies may be uniquely configured so that they may only be associated with fixtures for which they are intended to be associated. Furthermore, exemplary embodiments may provide an ultraviolet light lamp fixture, which may be configured so as to receive a particular and specific ultraviolet lamp base for a specific intended purpose, and so that errors in placement as to energy level and the like are eliminated or reduced. Further provided may be a methodology for insuring that ultraviolet lamp assemblies are placed in specific fixtures for which one, and only one type, of lamp is intended to be utilized.

Information as herein shown and described in detail is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described preferred embodiment and additional embodiments that are known to those of ordinary skill in the art are hereby expressly incorporated by reference and are intended to be encompassed by the present claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, that various changes and modifications in form, material, and fabrication material may be made, without departing from the spirit and scope of the inventions as set forth in the appended claims, should be readily apparent to those of ordinary skill in the art. No claim herein is to be construed under the provisions of 35 U.S.C. § 112, sixth paragraph, unless the element is expressly recited using the phrase "means for."

INDUSTRIAL APPLICABILITY

The present invention industrially applies to lamp systems. More specifically, the present invention industrially applies to ultraviolet lamp systems. Even more specifically, the present invention industrially applies to ultraviolet lamp systems having a keying device.

What is claimed is:

1. A lamp keying system, comprising:

a lamp base including a recess at one end;

a lamp support, having a lamp support receptacle, being detachably coupled to the lamp base, and including a first portion to receive the lamp base and a second portion being recessed away from the received lamp base; and a lamp keying device selected from a group consisting essentially of:

a. a keying device comprising at least one base protruding key being formed on the base and at least one support slot being formed in the lamp support receptacle, the at least one base protruding key detachably coupling with the at least one support slot;

b. a keying device comprising at least one support protruding key being formed on the lamp support receptacle and at least one base slot being formed in the base, the at least one base slot detachably coupling with the at least one protruding support key; and c. a keying device comprising at least one base protruding key being formed on the base and at least one base slot being formed in the base, the keying device further comprising at least one complementary support protruding key being formed on the lamp support receptacle and at least one complementary support slot being formed in the lamp support receptacle, the at least one base protruding key detachably Coupling with the at least one complementary support slot, and the at least one base slot detachably coupling with the at least one complementary protruding support key;

wherein the lamp base is operatively coupled to an electromagnetic energy source;

wherein the operatively coupled electromagnetic energy source is an ultraviolet light source.

2. A system, as recited in claim 1, wherein the lamp base is configured for operative coupling to the lamp support.

3. A system, as recited in claim 1, wherein the at least lamp keying device is configured to allow at least one pre-seleted lamp base type to be operatively associated with the lamp support.

4. A system, as recited in claim 1, wherein the lamp support comprises at least one material selected from a group consisting essentially of a metal, a polymer, a plastic, a ceramic, and a composite.

5. A system, as recited in claim 1, wherein said at least one lamp keying device comprises at least one material selected from a group consisting essentially of a metal, a polymer, a plastic, a ceramic, and a composite.

6. A system, as recited in claim 5, wherein the at least one metal keying device is configured to flex sufficiently to allow operative coupling of the lamp base to the lamp support.

7. A system, as recited in claim 1, wherein the metal base comprises at lest one material selected from a group consisting essentially of a metal, a polymer, a plastic, a ceramic, and a composite.

8. A system, as recited in claim 1, wherein the lamp base includes a plurality of electrical contacts, and wherein the lamp support includes a corresponding plurality of electrical contacts in the first portion of the lamp support.

9. A system, as recited in claim 8, wherein the plurality of electrical lamp base contacts are configured for operative coupling to the corresponding plurality of electrical contacts of the lamp support.

10. A lamp keying system, comprising:

a lamp base;

a lamp support having a lamp support receptacle and being configured to detachably receive the lamp base, the lamp support being recessed away from the received lamp base; and a lamp keying device selected from a group consisting essentially of:

a. a keying device comprising at least one base protruding key being formed on the base and at least one support slot being formed in the lamp support receptacle, the at least one base protruding key detachably coupling with the at least one support slot in a selectively interlocked manner;

b. a keying device comprising at least one support protruding key being formed on the lamp support receptacle and at least one base slot being formed in the base, the at least one base slot detachably coupling with the at least one protruding support key in a selectively interlocked manner; and c. a keying device comprising at least one base protruding key being formed on the base and at least one base slot being formed in the base, the keying device further comprising at least one complementary support protruding key being formed on the lamp support receptacle and at least one complementary support slot being formed in the lamp support receptacle, the at least one base protruding key detachably coupling with the at least one complementary support slot in a selectively interlocked manner, and the at least one base slot detachably coupling with the at least one complementary protruding support key in a selectively interlocked manner;

wherein the lamp base is operatively coupled to an electromagnetic energy source;

wherein the operatively coupled electromagnetic energy source is an ultraviolet light source.

11. A lamp keying system, comprising:

a lamp base including a recess at one end;

a lamp support having a lamp support receptacle, being detachably coupled to the lamp base, and including a first portion to receive the lamp base and a second portion being recessed away from the received lamp base; and a lamp keying device selected from a group consisting essentially of:

a. a keying device comprising at least one base protruding key being formed on the base and at least one support slot being formed in the lamp support receptacle, the at least one base protruding key detachably coupling with the at least one support slot;

b. a keying device comprising at least one support protruding key being formed on the lamp support receptacle and at least one base slot being formed in the base, the at least one base slot detachably coupling with the at least one protruding support key; and c. a keying device comprising at least one base protruding key being formed on the base and at least one base slot being formed in the base, the keying device further comprising at least one complementary support protruding key being formed on the lamp support receptacle and at least one complementary support slot being formed in the lamp support receptacle, the at least one base protruding key detachably coupling with the at least one complementary support slot, and the at least one base slot detachably coupling with the at least one complementary protruding support key, wherein the lamp base is operatively coupled to an electromagnetic energy source and is configured for operative coupling to the lamp support, wherein the operatively coupled electromagnetic energy source is an ultraviolet light source, wherein the lamp base includes a plurality of electrical contacts, wherein the lamp support includes a corresponding plurality of electrical contacts in the first portion of the lamp support, wherein the plurality of electrical lamp base contacts are configured for operative coupling to the corresponding plurality of electrical contacts of the lamp support, wherein the at least one keying device comprises at least one material selected from a group consisting essentially of a metal, a polymer, a plastic, a ceramic, and a composite, wherein the lamp base comprises at least one material selected from a group consisting essentially of a metal, a polymer, a plastic, a ceramic, and a composite, and wherein the lamp support comprises at least one material selected from a group consisting essentially of a metal, a polymer, a plastic, a ceramic, and a composite.

12. A method of fabricating a lamp keying system, comprising the steps of:

providing a lamp base including a recess at one end;

providing a lamp support, having a lamp support receptacle, being detachably coupled to the lamp base, and including a first portion to receive the lamp base and a second portion being recessed away from the received lamp base; and providing a lamp keying device selected from a group consisting essentially of:

a. a keying device comprising at least one base protruding key being formed on the base and at least one support slot being formed in the lamp support receptacle, the at least one base protruding key detachably coupling with the at least one support slot;

b. a keying device comprising at least one support protruding key being formed on the lamp support receptacle and at least one base slot being formed in the base, the at least one base slot detachably coupling with the at least one protruding support key; and c. a keying device comprising at least one base protruding key being formed on the base and at least one base slot being formed in the base, the keying device further comprising at least one complementary support protruding key being formed on the lamp support receptacle and at least one complementary support slot being formed in the lamp support receptacle, the at least one base protruding key detachably coupling with the at least one complementary support slot, and-the at least one base slot detachably coupling with the at least one complementary protruding support key;

wherein the lamp base providing step comprises operatively coupling the lamp base to an electromagnetic energy source;

wherein the lamp base providing step comprises providing the electromagnetic energy source as an ultraviolet light source.

13. A method, as recited in claim 12, wherein the lamp base providing step comprises configuring the lamp base for operative coupling to the lamp support.

14. A method, as recited in claim 12, wherein the at least one lamp keying device providing step comprises configuring the at least one lamp keying device to allow at least one pre-selected lamp base type to be operatively associated with the lamp support.

15. A method, as recited in claim 12, wherein the lamp support providing step comprises providing at least one material selected from a group consisting essentially of a metal, a polymer, a plastic, a ceramic, and a composite.

16. A method, as recited in claim 12, wherein the lamp base providing step comprises providing at least one material selected from a group consisting essentially of a metal, a polymer, a plastic, a ceramic, and a composite.

17. A method, as recited in claim 12, wherein said at least one lamp keying device providing step comprises providing at least one material selected from a group consisting essentially of a metal, a polymer, a plastic, a ceramic, and a composite.

18. A method, as recited in claim 17, wherein the at least one metal lamp keying device providing step comprises configuring the at least one metal lamp keying device to flex sufficiently to allow operative coupling of the lamp base to the lamp support.

19. A method, as recited in claim 12, wherein the lamp base providing step comprises providing a plurality of electrical contacts, and wherein the lamp support providing step comprises providing a corresponding plurality of electrical contacts in the first portion of the lamp support.

20. A method, as recited in claim 19, wherein the plurality of electrical lamp base contacts providing step comprises configuring the plurality of electrical lamp base contacts for operative coupling to the corresponding plurality of electrical contacts of the lamp support.

21. A method of fabricating a lamp keying system, comprising:

providing a lamp base;

providing a lamp support having a lamp support receptacle and being configured to detachably receive the lamp base, the lamp support being recessed away from the received lamp base; and providing a lamp keying device selected from a group consisting essentially of:

a. a keying device comprising at least one base protruding key being formed on the base and at least one support slot being formed in the lamp support receptacle, the at least one base protruding key detachably coupling with the at least one support slot in a selectively interlocked manner;

b. a keying device comprising at least one support protruding key being formed on the lamp support receptacle and at least one base slot being formed in the base, the at least one base slot detachably coupling with the at least one protruding support key in a selectively interlocked manner; and c. a keying device comprising at least one base protruding key being formed on the base and at least one base slot being formed in the base, the keying device further comprising at least one complementary support protruding key being formed on the lamp support receptacle and at least one complementary support slot being formed in the lamp support receptacle in a selectively interlocked manner, the at least one base protruding key detachably coupling with the at least one complementary support slot, and the at least one base slot detachably coupling with the at least one complementary protruding support key in a selectively interlocked manner;

wherein the lamp base providing step comprises operatively coupling the lamp base to an electromagnetic energy source;

wherein the lamp base providing step comprises providing the electromagnetic energy source as an ultraviolet light source.

22. A method, as recited in claim 21, wherein the lamp base providing step comprises configuring the lamp base for operative coupling to the lamp support, wherein the at least one lamp keying device providing step comprises configuring the at least one lamp keying device to allow at least one pre-selected lamp base type to be operatively associated with the lamp support, wherein the lamp support providing step comprises providing at least one material selected from a group consisting essentially of a metal, a polymer, a plastic, a ceramic, and a composite, wherein said at least one lamp keying device providing step comprises providing at least one material selected from a group consisting essentially of a metal, a polymer, a plastic, a ceramic, and a composite, wherein the lamp base providing, step comprises providing at least one material selected from a group consisting essentially of a metal, a polymer, a plastic, a ceramic, and a composite, wherein the lamp base providing step comprises providing a plurality of electrical contacts, wherein the lamp support providing step comprises providing a corresponding plurality of electrical contacts in the first portion of the lamp support, and wherein the plurality of electrical lamp base contacts providing step comprises configuring the plurality of electrical lamp base contacts for operative coupling to the corresponding plurality of electrical contacts of the lamp support.

23. A method of using a lamp keying system, comprising the steps of:

providing a lamp base including a recess at one end;

providing a lamp support, having a lamp support receptacle, being detachably coupled to the lamp base, and including a first portion to receive the lamp base and a second portion being recessed away from the received lamp base;

providing a lamp keying device selected from a group consisting essentially of:

a. a keying device comprising at least one base protruding key being formed on the base and at least one support slot being formed in the lamp support receptacle, the at least one base protruding key detachably coupling with the at least one support slot;

b. a keying device comprising at least one support protruding key being formed on the lamp support receptacle and at least one base slot being formed in the base, the at least one base slot detachably coupling with the at least one protruding support key; and c. a keying device comprising at least one base protruding key being formed on the base and at least one base slot being formed in the base, the keying device further comprising at least one complementary support protruding key being formed on the lamp support receptacle and at least one complementary support slot being formed in the lamp support receptacle, the at least one base protruding key detachably coupling with the at least one complementary support slot, and the at least one base slot detachably coupling with the at least one complementary protruding support key; and coupling and keying the lamp base to the lamp support by way of the at least one lamp keying device;

wherein the lamr base providing step comprises operatively coupling the lamp base to an electromagnetic energy source;

wherein the lamp base providing step comprises providing the electromagnetic energy source as an ultraviolet light source.

* * * * *